United States Patent [19]

Lee

[11] Patent Number: 4,957,272

[45] Date of Patent: Sep. 18, 1990

[54] MODULAR CONCRETE FORM

[76] Inventor: Yuan-Ho Lee, No. 851, Chung-San Rd., Nan-Pao Tsun, Kuei-Jen Hsian, Tainan Hsieng, Taiwan

[21] Appl. No.: 370,757

[22] Filed: Jun. 23, 1989

[51] Int. Cl.[5] ..... E04G 9/02; E04G 17/14

[52] U.S. Cl. ..... 249/196; 249/47; 249/210

[58] Field of Search ..... 249/1, 13, 18, 33, 47, 249/165, 189, 192, 196, 207, 210, 219.1, 219.2; 52/582, 585, 645, 726

[56] References Cited

U.S. PATENT DOCUMENTS

| | | | |
|---|---|---|---|
| 3,525,191 | 8/1970 | Hunnebeck et al. | 52/645 |
| 4,040,774 | 8/1977 | Scheller | 249/20 |
| 4,177,968 | 12/1979 | Chapman | 249/211 |
| 4,525,974 | 7/1985 | Steidle-Sailer et al. | 52/726 |
| 4,569,501 | 2/1986 | McCracken | 52/645 |
| 4,667,923 | 5/1987 | Lee | 249/193 |

*Primary Examiner*—James C. Housel
*Attorney, Agent, or Firm*—Ladas & Parry

[57] ABSTRACT

A modular form includes form plates in edge-to-edge contiguity, fasteners provided along adjacent longitudinal sides of the plates to fasten releaseably the form plates, reinforcement channel pieces attached detachably to the form plates along the transverse sides thereof, and trussed backing members extending longitudinally between the channel pieces, each of the trussed backing members having two opposite joint ends, the joint ends being detachably connected to the channel pieces.

5 Claims, 6 Drawing Sheets

MODULAR CONCRETE FORM

BACKGROUND OF THE INVENTION

This invention relates to a concrete form for forming a concrete structure and particularly to a modular concrete form unit including a form plate backed by transverse channel pieces detachably provided along transverse sides of the form plate and trussed backing members longitudinally extending and detachably connected to the channel pieces.

It is now a common practice to assemble modular form panels to a large form board which can be stripped entirely from a formed concrete structure and which can be used repeatedly to form similar concrete structures without the need to disemble and reassemble the form board. Generally, such form panels include a plate member and reinforcement members connected to the back of the plate. U.S. Pat. No. 2,544,297 discloses a foldable form including a steel panel and a plurality of longitudinal and transverse reinforcement struts which are connected to the panel for backing purposes by a time-consuming welding process. Well known steel-ply panels which are manufactured by Symon Corporation include rectangular plywood panels arranged in edge-to-edge contiguity, and a rectangular reinforcing frame is used to back the plywood panels. Usually, in conventional form boards, thick panels are utilized to increase the strength of the form panel or minimize the deflection of the panel, thereby increasing the weight of the form assembly. Furthermore, the backing members to reinforce conventional form panels are usually welded to the form panels so that the variable dimension of form panels is an integral multiple of the dimension of standard form panels, thereby limiting the variation in dimension of the form panels.

SUMMARY OF THE INVENTION

According to the present invention, a modular form assembly which includes at least two panel plates each of which has a pair of longitudinal sides and a pair of transverse sides, first fastening means provided along the longitudinal sides to fasten releaseably the panel plates, reinforcement channel pieces attached to the panel plates along the transverse sides, and second fastening means to fasten the channel pieces together, trussed backing members extending longitudinally between the channel pieces each of which has two opposite joint ends, third fastening means to fasten releaseably the joint ends to the reinforcement channel pieces.

It is an object of the invention to provide a concrete form in which the reinforcement backing members are not welded to form plates.

It is another object of the invention to provide a modular form unit including a modular plate unit which can be connected directly and detachably to other units and a modular reinforcement backing unit which can be connected detachably to the plate unit and other backing units so that the backing unit can be detached easily from the plate unit after the modular units are assembled together. The present invention permits the plate unit to be cut so that the dimension thereof can be changed from its standard size without the need to cut the backing unit for a next forming operation which would require the setting up of a form which is different from that previously used.

It is another object of the present invention to provide modular reinforcement backing members which can be assembled easily to back panel plates of various sizes.

It is further object of the present invention to provide modular reinforcement backing members which can contribute different desired strengths to panel plates for different structures by changing the number of the backing numbers to be attached to the panel plates.

It is still a further object of the present invention to provide simple fasteners to interconnect adjacent panel plates.

It is yet a further object of the present invention to provide simple connectors to interconnect adjacent backing members.

It is yet a further object of the present invention to provide a modular form assembly in which adjacent panel plates as well as adjacent reinforcement backing members are fastened firmly together, thereby minimizing the risk of deforming the form assembly.

The present exemplary preferred embodiment will be described in detail with reference to the accompanying drawings, in which:

BRIEF DESCRIPTION OF THE DRAWINGS v

DETAILED DESCRIPTION OF THE PREFERRED EMBODIMENT

Figure 1:
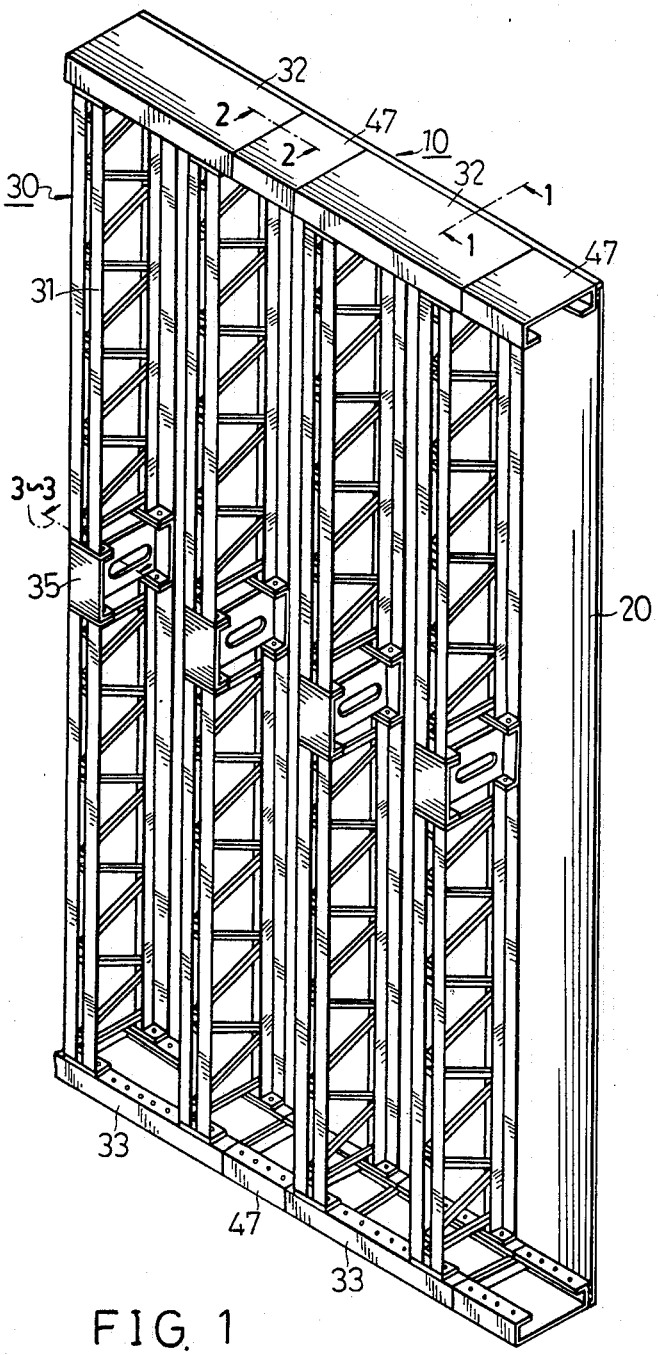
FIG. 1 is a perspective view of a form assembly according to the present invention.

Referring to FIG. 1, a form board 10 according to the present invention includes panel plates 20 and a backing frame 30 which is constituted of a trussed backing frame 31 and channel members 32, 33.

Figure 2:
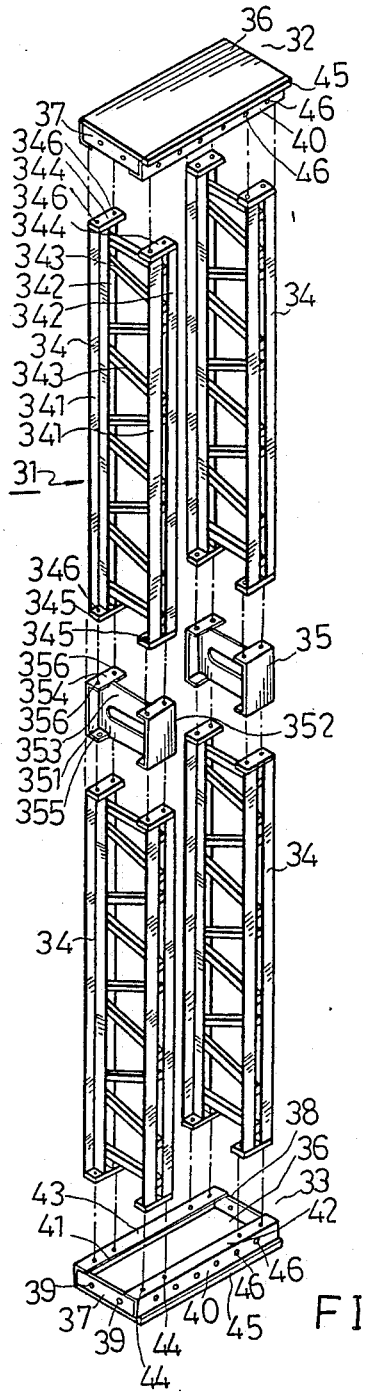
FIG. 2 is an exploded view showing a portion of the form assembly.

As shown in FIG. 2, the trussed backing frame 31 is constituted of modular trussed backing members 34 and connectors 35. Each upper or lower channel member 32 or 33 has a plate member 36, two opposite longitudinal backward flanges 40, 41, two opposite flanges 42, 43 extending inward from the backward flanges 40, 41 respectively, and two opposite transverse flanges 37 and 38. Screw holes 39 are provided in the flanges 37, 38, screw holes 44 are provided in the flanges 42, 43, and screw holes 46 are provided in the flange 40. A side flange 45 extends from the backward flange 40 and is coplanar with the plate member 36.

Each trussed backing member 34 includes four parallel angled bars 341 and 342 and a plurality of inclined span rods 343 of rectangular cross-section welded to the angled bars 341 and 342 therebetween. Upper and lower end pieces 344 and 345 are welded to two opposite ends of the angled bars 341 and 342. Screw holes 346 are provided in the end pieces 344 and 345 so that the end pieces 344 and 345 can be fastened to the channel pieces 32 and 33.

Connectors 35 are used to interconnect detachably the trussed backing members 34 so that the length of the trussed backing members 34 can be reduced or increased as desired. Each connector 35 includes two opposite plates 351 and 352 and a web member 355 interconnecting the plates 351 and 352. The plates 351 and 352 are provided with flanges 354 and 355 having screw holes 356 so that the flanges 354 and 355 can be screwed to the end plates of the trussed backing member 34. The connector 35 may be a one piece member which is formed by casting.

Figure 3:
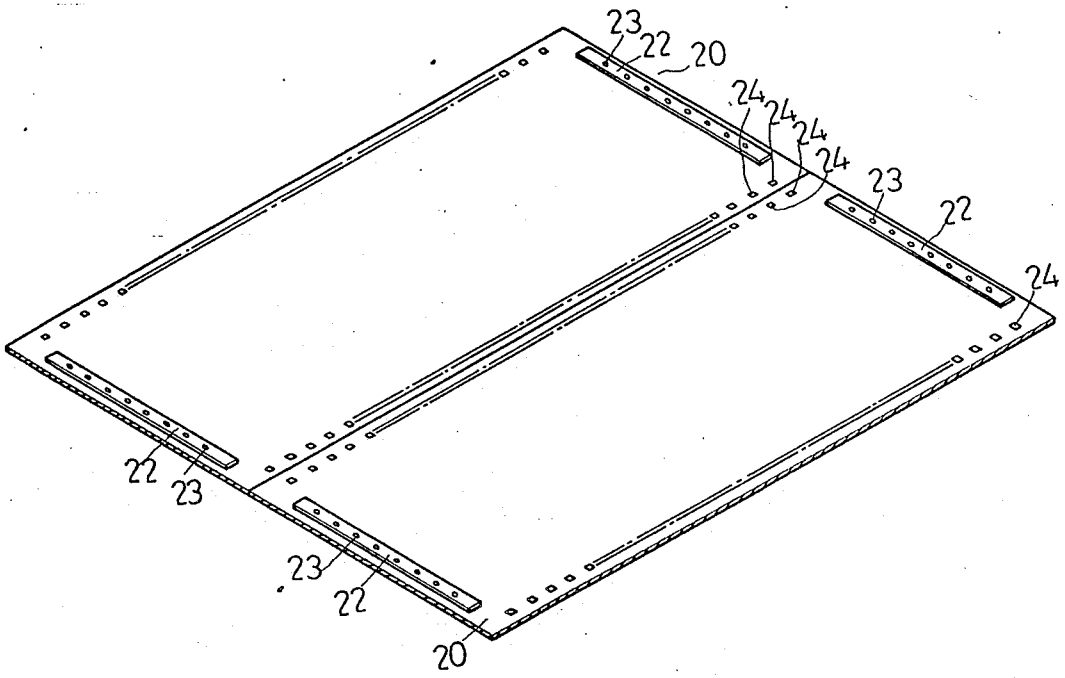
FIG. 3 is a perspective view showing two adjacent panel plates.
Figure 4:
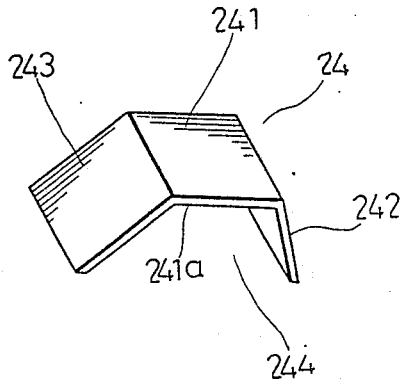
FIG. 4 shows a looped member of a fastener used to fasten two adjacent panel plates.
Figure 5:
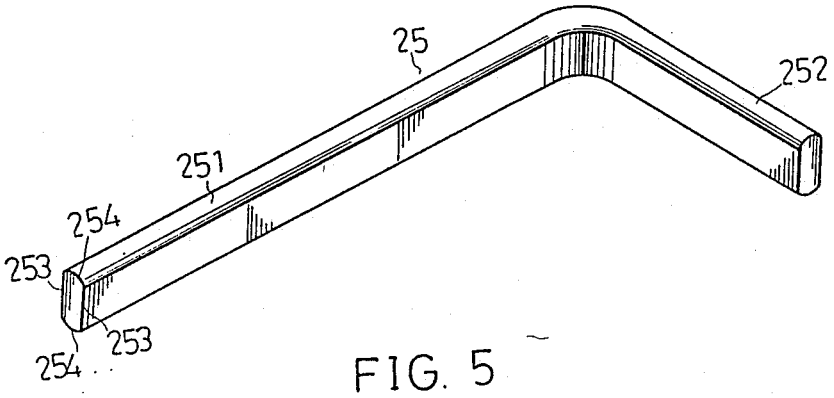
FIG. 5 shows a key member to cooperate with the looped member.
Figure 6:
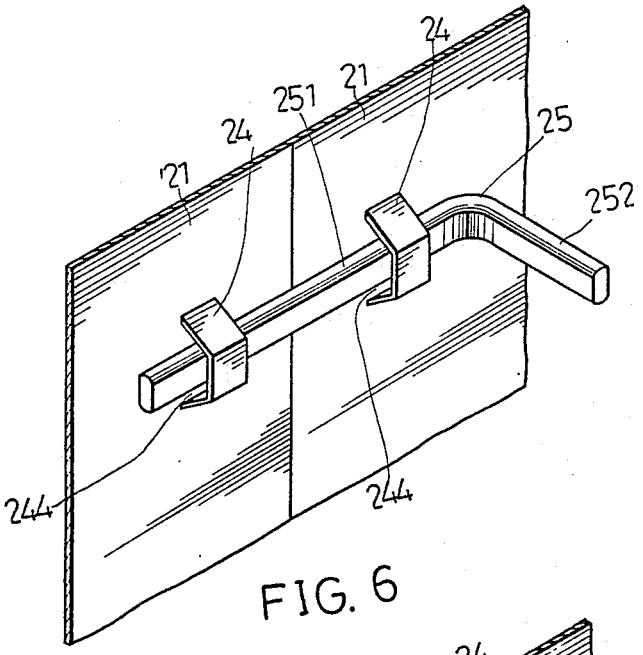
FIGS. 6 and 7 show how the two panel plates are fastened together.
Figure 7:
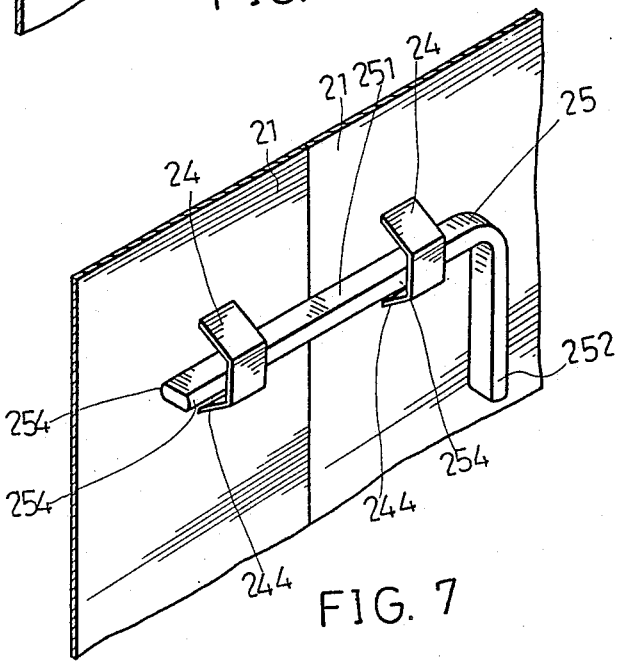

Each panel plate 20 can be connected detachably to the other panel plate 20. Referring to FIG. 3, each panel 20 is provided with ribs 22 respectively at transverse sides thereof, and screw holes 23 are provided in the ribs 22 to permit channel members 32, 33 to be fastened together by means of screws.

Two adjacent panels 20 can be fastened together by means of a fastener means. Referring to FIGS. 4, 5, 6 and 7 in combination with FIG. 4, the fastener means includes looped members 24 which are provided at intervals along longitudinal sides on the back of the form panels 20. Each looped member 24 on one of the panels 20 is respectively aligned with the looped members 20 on the adjacent panel 20.

Each looped member 24 has a substantially planar engagement member 241 with an inner engagement face **241*a* and two flanks 242 and 243 which are welded to the back face of each form panel. The engagement member 241 and the flanks 242 and 243 of each looped member confine an opening 244** with the back face of the form panel.

The fastener means used to fasten the form panels further includes key members 25 each having an insert rod portion 251 to be inserted in two aligned looped members 24 and a handle rod portion 252 which forms an angle with the insert rod portion 251. The insert rod portion 252 has a substantially rectangular cross-section and has a pair of first opposed longitudinal faces 253, and a pair of second opposed longitudinal faces 254. The length between the first opposed faces 253 is smaller than that between the engagement face **241*a* and the back face of the form panel 20 so that the key rod portion 251 can be inserted into aligned looped members 24. The length between the second opposed faces 254 is greater than that between the engagement face 241*a* and the back face of the form panel 20 so that the faces 254 contiguously engage respectively with the engagement face 241*a* of the looped member 24 and the back face of the form panel 20 when the insert rod portion 251 is turned 90 degrees after being inserted. Preferably, the opposed faces 254 are curved slightly so that the key member 25 can be turned smoothly. The panel plates are fastened together firmly when the key members 25 are respectively inserted into two aligned looped members 24** and turned 90 degrees.

In assembly, the panel plates 20 are arranged in edge-to-edge contiguity and fastened by means of looped members 24 and key members 25. Channel pieces 32, 33 are screwed to the side portions of the panel plates, and then the trussed backing members 34 are screwed to the channel pieces 32, 33. If it is necessary to increase the length of the trussed backing members additional trussed backing members can be connected to the existing trussed backing members by means of connectors 35.

Figure 8:
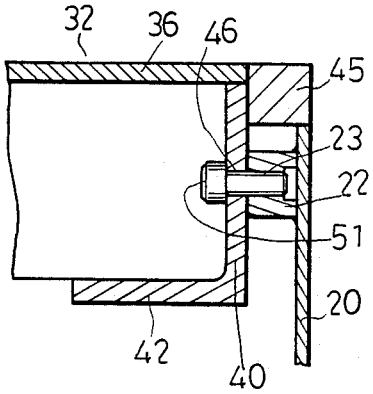
FIG. 8 shows a fragmentary sectional view taken along line I—I of FIG. 1.
Figure 9:
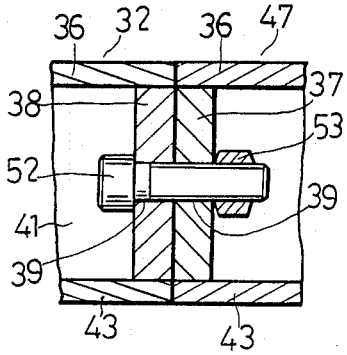
FIG. 9 shows a fragmentary sectional view taken along line II—II of FIG. 1.
Figure 10:
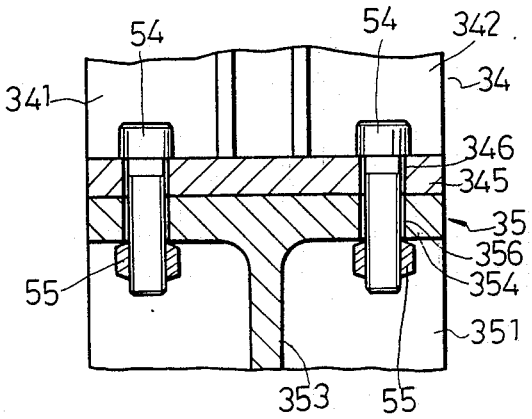
FIG. 10 shows a fragmentary sectional view taken along line III—III of FIG. 1.

FIGS. 8 to 10 show the connection between the components of the assembly embodying the present invention. Referring to FIG. 8 in combination with FIG. 1, channel piece 32 is attached to panel plate 20 by screwing the flange 40 thereof to the rib 22 by means of a screw 51. The screw 51 does not thread through the panel plate 20. The side flange 45 which has a thickness substantially similar to that of the rib 22 bears against the panel plate 20 so that the channel piece 32 is secured firmly to the plate 20 without swinging.

Referring to FIG. 9 in combination with FIG. 1, channel piece 32 is connected to an adjacent auxiliary channel piece 47 which is used to extend the length of the channel piece 32 by abutting transverse flanges 37 and 38 against one another and fastening them together by means of screws 52.

Referring to FIG. 10 in combination with FIG. 1, the trussed backing member 34 is connected to the connecting member 35 by abutting the end piece 345 thereof against the flange 354 of the connecting member 35 and fastening them to one another by means of screws 55.

The above described modular components can be constructed as desired to form assemblies having different dimensions. If an assembled form is required to be used for forming a structure having a dimension which cannot be formed with that form as presently assembled, one can easily dissemble the form and the panel plate can be cut to a non-standard size without the need to cut backing members. After the altering of the panel plate, backing members can be re-attached to the cut panel plate in their proper positions.

It can be noted that the spacing between the trussed backing members can be varied, that is to say, the degree of the reinforcement provided by the backing members is variable, so that the form of the present invention can be obtained with different strengths according to the different requirements of forms, by varying both the number of the trussed backing members attached to the panel plates and the spacing between the trussed backing members. In practice, channel pieces 32, 33 having a length of 640 mm and a spacing of 440 mm between two trussed backing members 34 provide a good backing strength. The trussed backing members 4 are arranged in standard lengths of 120 cm, 140 cm and 160 cm. Therefore a variety members can be obtained from different combinations of standard lengths.

With the invention thus explained, it is apparent that various modifications and variations can be made without departing from the scope of the invention. It is therefore intended that the invention be limited only as indicated in the appended claims.

What I claim is:

1. A form assembly comprising:

form plates arranged in edge-to-edge contiguity, each of said plates having a pair of longitudinal sides and a pair of transverse sides;

a fastening means provided along said longitudinal sides to fasten releasably said form plates;

reinforcement channel pieces attached detachably to said form plates along said transverse sides; and trussed backing members extending longitudinally between said channel pieces, each of said trussed backing members having two opposite joint ends, said joint ends being detachably connected to said channel pieces, wherein each of said channel pieces includes a plate member, two opposite longitudinal backward flanges extending from two opposite sides of said plate member of said channel piece, one of said opposite longitudinal backward flanges abutting with said form plate for connection thereto, two opposite inward flanges respectively extending from said backward flanges and defining threaded holes therein, and opposite transverse backward flanges extending from said plate member of said channel pieces between said longitudinal backward flanges.

2. A form assembly as claimed in claim 1, wherein said fastening means includes a plurality of looped members projecting from each of said form plates adjacent to said longitudinal sides, said looped members of each of said form plates being respectively aligned with said looped members of an adjacent said form plate, each of said looped members having an engagement face spaced apart from said form plate and two spaced apart opposed side flanks connected securely to said form plate on two sides of said engagement face, the distance between said flanks being greater than that between said engagement face and said back face, and key members each having an insert rod portion to be inserted in at least two aligned said looped members and a handle rod portion which forms an angle with said insert rod portion, said insert rod portion having a pair of first opposed longitudinal faces, and a pair of second opposed longitudinal faces, the distance between said first opposed faces being smaller than said distance between said engagement face and said form plate so that said key rod portion can be inserted into aligned said looped members, the distance between said second opposed faces being greater than the distance between said first opposed faces, said second opposed faces being engaged with said engagement faces of said looped members and said form plate when said insert rod portion is turned an angle after being inserted.

3. A form assembly as claimed in claim 2, wherein said insert rod portion has a substantially rectangular cross-section, and said second opposed faces are convexed.

4. A form assembly as claimed in claim 1, wherein each of said trussed backing members is provided with two opposite transverse joint end plate members abutted with said inward flanges of said channel pieces.

5. A form assembly as claimed in claim 4, further comprising connecting pieces to interconnect said trussed backing members, said connecting pieces being detachably connected to said trussed backing members, wherein each of said connecting pieces is a one-piece member having two spaced parallel plate members and a transverse web interconnecting said spaced parallel plate members, said spaced parallel plate members being provided with opposite right-angled flanges abutting with said joint end plate members for connection thereto.

* * * * *